US005582883A

United States Patent [19]

Keshishian

[11] Patent Number: 5,582,883

[45] Date of Patent: Dec. 10, 1996

[54] PORTABLE RELIGIOUS SHRINE

[76] Inventor: Nshan Keshishian, 5317 Virginia Ave., Los Angeles, Calif. 90029

[21] Appl. No.: 8,640

[22] Filed: Jan. 25, 1993

[51] Int. Cl.[6] ..... A47G 33/02

[52] U.S. Cl. ..... 428/3; 206/19; 434/245

[58] Field of Search ..... 206/19; 428/3; 434/245

[56] References Cited

U.S. PATENT DOCUMENTS

| | | | |
|---|---|---|---|
| 2,656,915 | 10/1953 | Reising | 206/19 |
| 3,085,839 | 4/1963 | Gallagher | 206/19 X |
| 3,604,825 | 9/1971 | Leshko | 431/290 |
| 4,262,325 | 4/1981 | Garcia | 362/121 |
| 4,455,772 | 6/1984 | Miller | 40/124.5 |
| 4,866,863 | 9/1989 | Scarcello | 40/124.5 |

*Primary Examiner*—Henry F. Epstein
*Attorney, Agent, or Firm*—Nathan Boatner

[57] ABSTRACT

A portable religious shrine that is suitable for use at a gravesite comprising a portable enclosure with a plurality of compartments and a folding windscreen suitable for use in the burning of candles, burning of incense, and storage of objects such as a bible and a photograph or picture.

5 Claims, 1 Drawing Sheet

PORTABLE RELIGIOUS SHRINE

BACKGROUND OF THE INVENTION

This invention relates to religious shrines and objects used in ceremony at the gravesite of one bereaved by the user of the shrine and more particularly to portable religious shrines.

Heretofore when a person or family visits the gravesite of a beloved person objects such as a bible, candles, incense and the like traditionally are carried to the gravesite. Then at the gravesite the usual commemorative objects would be used without benefit of an altar or shrine all of which is inconvenient to the person visiting the gravesite.

R. G. Reising in U.S. Pat. No. 2,656,915, issued in 1950 discloses a utility sick call case suitable for use by a priest in administering the rites of the Roman Catholic Church to the sick and dying. This sick call case would not be suitable for use at a gravesite in a commemorative ceremony by one bereaved by the loss of a beloved person, however.

E. F. Gallagher in U.S. Pat. No. 3,085,839, issued in 1961 discloses a shrine case that is also useful as a two piece assembly which can be used as a case for a bible or other book. The shrine case would be suitable for use in the home as a decorative object or even a support for an open book. However, again the shrine case is not suitable for use at a gravesite because it requires electricity for operation of the lamp which is a part of the shrine case.

Garcia in U.S. Pat. No. 4,262,325, issued in April of 1981 discloses an altar with candle holders. This altar is not, however, suitable for storage of objects such a a bible that might be used as a gravesite and is not portable.

Miller in U.S. Pat. No. 4,455,772, issued in January of 1984 discloses a memorial display case that could be used at a gravesite. This case, however, is not portable and would not be suitable for holding burning candles which might be appropriate at a gravesite.

The object of the present invention is to overcome the disadvantages of the prior art and to provide a portable shrine that can be used to hold a burning candle and incense, that can be used to store objects used when visiting a gravesite such as a bible, and that can be stored at the gravesite or at the cemetery office for use at the gravesite by one bereaved.

SUMMARY OF THE INVENTION

This invention consists of a rectangular enclosure that when opened acts as a portable shrine. Within the enclosure is a compartment for sand for holding candles which can be safely burned and extinguished in the sand. A folding shield is provided to shield the burning candles from the wind. A compartment with an incense holder is provided for use at a gravesite. Also a compartment is available for holding a bible or other objects that might be desired for use in a commemorative ceremony at a gravesite. A picture or photograph can be conveniently affixed to the top when opened. The entire enclosure can conveniently be stored at the gravesite or at the cemetery office. This provides a practical convenient means of observing a commemorative ceremony at the gravesite by one bereaved.

DESCRIPTION OF THE PREFERRED EMBODIMENT

Figure 1:
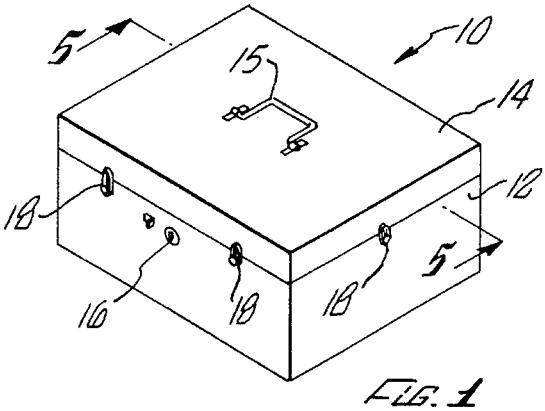
FIG. 1 is a perspective view of the portable shrine when closed.
Figure 3:
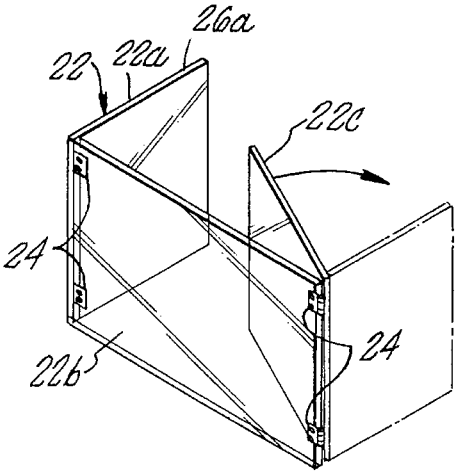
FIG. 3 is a perspective view of the wind screen when opened.
Figure 5:
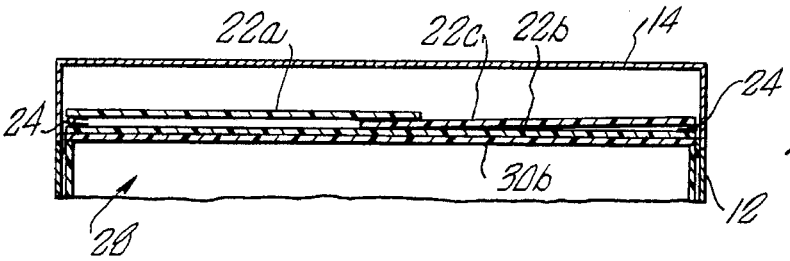
FIG. 5 is a side sectional view taken along the line 5—5 of FIG. 1 showing the wind screen folded inside of the portable shrine.
Figure 2:
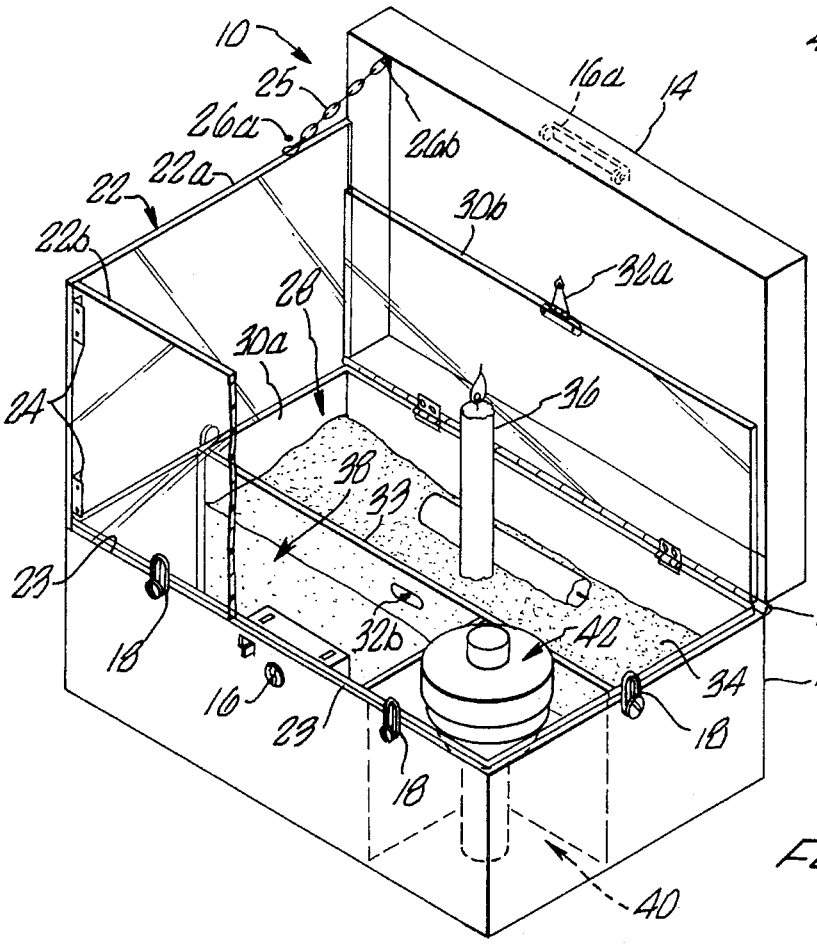
FIG. 2 is a perspective view of the portable shrine when opened with the wind screen partially shown.
Figure 4:
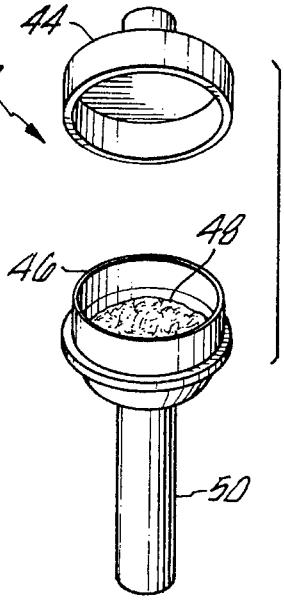
FIG. 4 is a perspective view of the incense holder that fits into a compartment in the shrine.

The portable shrine enclosure 10 is made of any kind of rigid material such as plastic or wood and preferably is made of metal. Within the enclosure 10 is a folding wind screen 22 preferably made of clear plastic but which could be made of any rigid material. The wind screen 22 is composed of three sections so that it can be unfolded and placed upon the enclosure 10 in a manner that will effectively shield the burning candles 36 within the enclosure 10 from the wind. The three sections of the wind screen 22 are joined by hinges 24 which permits the wind screen 22 to be folded for storage within the enclosure 10 when not in use. When unfolded the wind screen 22 fits on the enclosure 10 into a groove 23 which runs along three sides of the enclosure 10. The wind screen 22 is held in place in the groove 23 by means of stops 18. The stops 18 are movably affixed to the enclosure 10 so the stops can be rotated downwards to release the wind screen 22 when it is not in use. The wind screen 22 is secured to the top 14 of the enclosure 10 by a chain 25. The chain 25 is rigidly affixed to the top 14 of the enclosure 10 by a nail or pin **26*b* and removably affixed to the wind screen 22 by a pin or nail 26*a***.

When closed the enclosure 10 is secured by the stops 18 which swing upwards to secure the top 14. The top 14 is also secured by a tongue in groove latch, the tongue **16*a* of which fits into the groove 16. The top 14 is affixed to the bottom of the enclosure by means of a hinge 20**.

When the enclosure 10 is closed the wind screen 22 folds down and fits over the compartment dividers 33. The candle compartment 28 holds sand 34 and candles 36. The sand 34 acts to hold the burning candles 36 in place and also as a safety device to prevent the burning candle 36 from damaging the enclosure 10 and also permits the candle 36 to be extinguished in the sand 34. The candle compartment 28 has a hinged lid **30*b* which has a hook 32*a* that closes on a pin 32*b* to secure the compartment lid 30*b*. This lid 30*b*** is preferably made of clear plastic but could be made of any rigid material.

The enclosure 10 has an open compartment 40 into which is rigidly affixed an incense holder 42. The incense holder 42 has a columnar base 50, a compartment 46 for incense 48, and a top 44. The incense holder 42 can be made of any rigid material such as plastic, but the incense compartment 46 should be made of a fire resistant material such as ceramic material. Another compartment 38 can be used to store or hold a bible or any other suitable object.

A photograph, picture, or painting or the like of a religious figure, person, or some other desired thing can be cemented or otherwise affixed to the inside of the top 14.

When closed the enclosure 10 can be carried by the handle 15 and conveniently stored at a gravesite or at the office of a cemetery.

The description of the preferred embodiment of the invention is for the purpose of illustration only and is not meant to limit the disclosure of the present invention.

I claim:

1. A portable religious shrine comprising:

a bottom member with a base and four sides affixed to the base;

a top member affixed to the bottom member with a hinge the top member having a tongue in groove latch and a carrying handle;

a folding wind screen that fits into the closed portable religious shrine and that fits into a groove in the bottom member and to the top member of the portable religious shrine by means of a chain and hook when the portable religious shrine is in use;

stops movably affixed to the bottom member that swing upwards to hold the wind screen in place to the bottom member when the portable religious shrine is in use; and a plurality of internal compartments.

2. A portable religious shrine as recited in claim 1 further comprising:

a hinged top with a recess that will permit: a picture or photograph to be affixed thereto.

3. A portable religious shrine as recited in claim 1 further comprising:

an internal compartment with an incense holder therein.

4. A portable religious shrine as recited in claim 1 further comprising:

an internal compartment suitable for the placement of a religious book.

5. A portable religious shrine as recited in claim 1 further comprising:

an internally closable compartment wherein one or more candles may be burned.

* * * * *